US006443073B1

(12) United States Patent
Tsang et al.

(10) Patent No.: US 6,443,073 B1
(45) Date of Patent: Sep. 3, 2002

(54) EXTENDABLE TABLE

(75) Inventors: Shing Chi Tsang; Shing Yip Tsang, both of Tawau (MY)

(73) Assignee: B.T. Furnishing Sdn. Bhd. (MY)

( * ) Notice: Subject to any disclaimer, the term of this patent is extended or adjusted under 35 U.S.C. 154(b) by 0 days.

(21) Appl. No.: 09/546,646

(22) Filed: Apr. 10, 2000

(30) Foreign Application Priority Data

Apr. 12, 1999 (MY) ..... 9901406

(51) Int. Cl.[7] ..... A47B 1/00
(52) U.S. Cl. ..... 108/85; 108/86
(58) Field of Search ..... 108/85, 86, 84, 108/83

(56) References Cited

U.S. PATENT DOCUMENTS 907,926 A * 12/1908 Westerfield ..... 108/85
1,464,409 A * 8/1923 Cooklin ..... 108/85
1,874,509 A * 8/1932 Grundy et al. ..... 108/85
1,887,266 A * 11/1932 Karlson ..... 108/85

FOREIGN PATENT DOCUMENTS

NL 68554-a * 3/1951 ..... 108/85

* cited by examiner

*Primary Examiner*—Lanna Mai
*Assistant Examiner*—Jerry A. Anderson
(74) *Attorney, Agent, or Firm*—Wiggin & Dana, LLP

(57) ABSTRACT

An extendable table has a pair of main top panels (14, 16) and a pair of extension top panels (18, 20) that are stowable under the main panels. The main panels are secured to sliding frames (32) which are slidably movable relative to a fixed table frame (10). Each extension panel is seated on one sliding frame. As the main panel (14, 16) is pulled outwardly, the associated extension panel (18, 20) is automatically lifted up into the gap opened above the table frame (10), by interaction of guide means (42, 52) on the undersurface of the extension panel with the sliding frame (32) and the fixed frame (22).

7 Claims, 8 Drawing Sheets

EXTENDABLE TABLE

BACKGROUND OF THE INVENTION

1. Field of the Invention

This invention relates to an extendable table, that is to say a table in which the top surface can be expanded by the inclusion of one or more extension panels.

2. Description of the Related Art

There are two basic types of extendable table. In the first type, one or more extension panels are hinged to the edges of the main table panel. When an extension panel is to be used, a support rail is slid out from underneath the main table top to support the extension panel. One disadvantage of this construction is that the extension support rail is prone to break if a heavy load is placed on the extension panel. Additionally, the extension flaps hang vertically when not in use and this restricts leg room under the table.

The second type of extendable table has the extension panels provided in the centre of the table. The main table surface is provided by two sliding panels. The main panels are slid outwardly to open up a gap in the middle of the table frame where the extension panels are stowed. In one known construction, the extension panels comprise a pair of panels that are hinged together. These pair of panels must be manually lifted out of the table frame, unfolded to form a single extension surface, and then positioned in place. This known construction is inconvenient to use. The process of lifting and unfolding the extension panels is time-consuming and labour-intensive.

The invention is concerned with an improvement of the above second type of extendable table. The aim of the invention is to provide such a table which is more convenient to use and has a relatively simple construction.

BRIEF SUMMARY OF THE INVENTION

In accordance with the invention, an extendable table-comprises a fixed frame, a sliding frame arranged to be slidably-movable relative to said fixed frame, a main top panel secured to said sliding frame whereby said main top panel may be pulled outwardly to open up an extension gap over said fixed frame, and an extension top panel locatable on said sliding frame and within said extension gap to form a continuous extended table surface with said main top panel, wherein said extension top panel includes first guide means interacting with said sliding frame and second guide means interacting with said fixed frame whereby, when the main top panel is pulled outwardly, the extension top panel is caused to be lifted automatically within said extension gap from a lower position below the level of the main top panel to an upper position at the level of the main top panel, and wherein the extension top panel is stowed beneath the main top panel when the extension gap is closed.

This construction provides particular convenience to the user in that the extension panel is automatically raised into position merely by sliding the main top panel. Similarly, when it is desired to return the table to its regular size, the extension panel is automatically lowered and stowed below the main top panel by a simple sliding action. There is thus no need for the user to lift or handle the extension panel at all.

In a preferred embodiment, the sliding frame consists of a pair of mutually parallel rails extending in the sliding direction. The outer ends of the rails are secured to the undersurface of the main top panel. There is a clearance gap between the main panel and the rails on the inner edge side of the main panel. The extension panel is received and stowed in this clearance gap when not in use.

The underside of the extension panel has a pair of inner guide rails in positions corresponding to those of the sliding rails and a pair of outer guide rails in positions corresponding to the outer frame members of the fixed table frame.

In the preferred embodiment, the first guide means comprises a pair of downwardly facing inclined surfaces formed on each inner guide rail. These downwardly facing inclined surfaces of the extension panels interact with corresponding upwardly facing inclined surfaces formed on the sliding rails. The second guide means comprises a slot formed on each outer guide rail of the extension panel. This slot receives a corresponding stop block formed on the inside of each table frame member. The slot and stop block are inclined at an angle to the vertical.

When the table is to be extended, the main panel is pulled outwardly. The extension panel is withdrawn from the aforementioned clearance gap beneath the main panel, as the sliding rails slip under the extension panel. The extension panel is prevented from sliding at this time by virtue of the slots in the outer guide rails receiving the stop blocks of the main frame.

As the main panel is pulled further outwardly, the inclined surfaces on the sliding rails meet the corresponding inclined surfaces of the inner guide rails. The extension panel is then forced automatically upwardly as the separation distance between the sliding rail inclined surfaces and the stop blocks is reduced. The extension panel is thus directed upwardly in a scissors action. The extension panel rides up the inclined surfaces of the sliding rails until the inner guide rails of the extension panel sit atop the sliding frame rails. At this point, the outer guide rails of the extension panel have become released from the stop blocks, so that the extension panel can be slid inwardly into intimate edgewise contact with the main panel and the centre of the table, thereby forming the extended table surface.

In the preferred embodiment, there are two sliding main panels and two extension panels. Each extension panel is linked to its associated main panel by the mechanism described above. In this way, the table can be extended optionally by different amounts with the inclusion of one or both of the extension panels. It will be appreciated, however, that in an alternative embodiment there may be one fixed main panel and one sliding main panel, with a single extension panel associated with the sliding main panel.

BRIEF DESCRIPTION OF THE DRAWINGS

The invention is illustrated, but not limited, by the following description of a preferred embodiment with reference to the accompanying drawings, in which.

In this specification, unless the context otherwise requires, terms such as inner, inwardly, outer and outwardly are to be interpreted with reference to the inner centre of the table, as represented for example by the stop rail described herein.

DETAILED DESCRIPTION

Figure 1A:
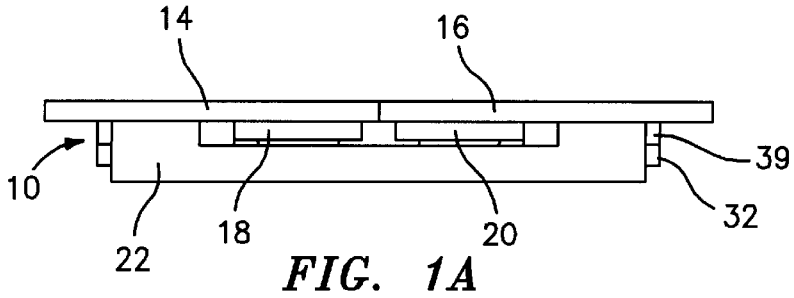
FIG. 1A is a side view of an extendable table in its normal, unextended condition.
Figure 2:
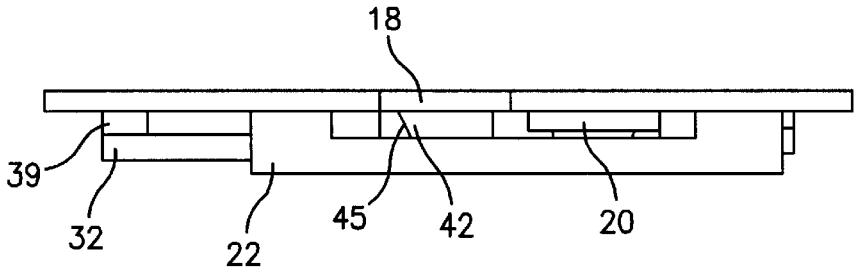
FIG. 2 shows the table extended by the inclusion of one of a pair of extension panels.
Figure 3:
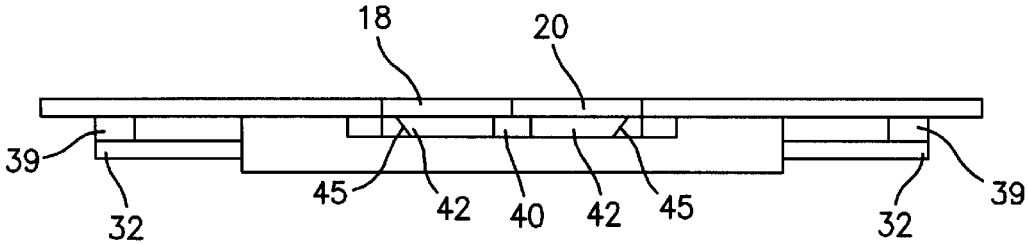
FIG. 3 shows the table extended by the inclusion of both extension panels.
Figure 1B:
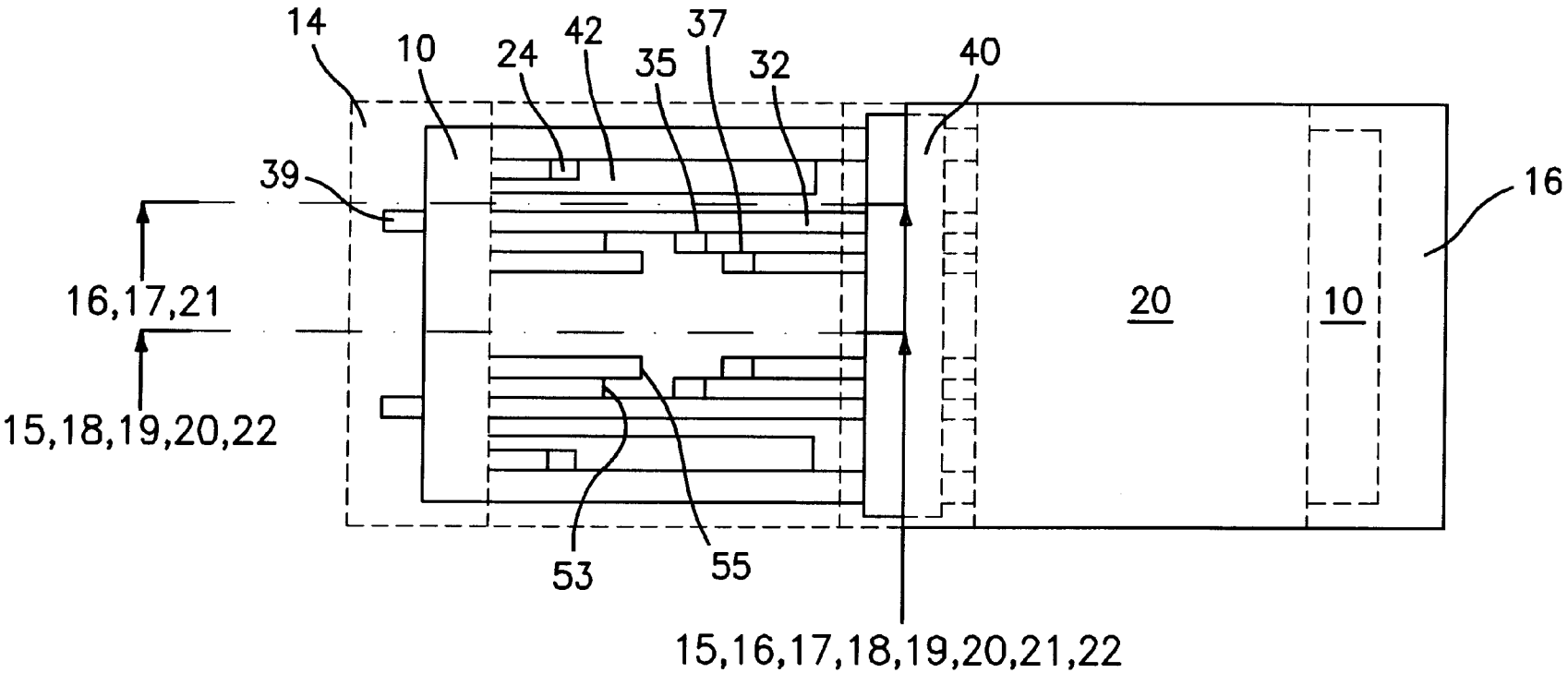
FIG. 1B is a top view of the extendable table with one of its main panels shown in phantom lines.

Referring to the drawings, FIGS. 1 to 3 show side views of the extendable table of the embodiment in various configurations. The table comprises a main frame 10 to which a set of legs (not shown) are secured in order to support the table above the ground. The top surface of the table is formed by a pair of main top panels 14, 16. These main panels are slidable in the horizontal direction so that they can be pulled outwardly and pushed inwardly with respect to the centre of the table.

The table further comprises a pair of extension panels 18, 20. In FIG. 1, the table is in its normal, unextended condition. In this case, the two extension panels 18, 20 are stowed beneath the respective main panels 14, 16 in a recess formed in the main frame 10.

FIG. 2 shows the table surface extended by the inclusion of one extension panel 18 by pulling the associated main panel 14 outwardly. FIG. 3 shows the table surface extended by the inclusion of both extension panels 18, 20 by respectively pulling out the main panels 14, 16.

The invention is concerned particularly with a mechanism by which the extension panels can be automatically moved between the upper in-use position and the lower stowed position.

Figure 4:
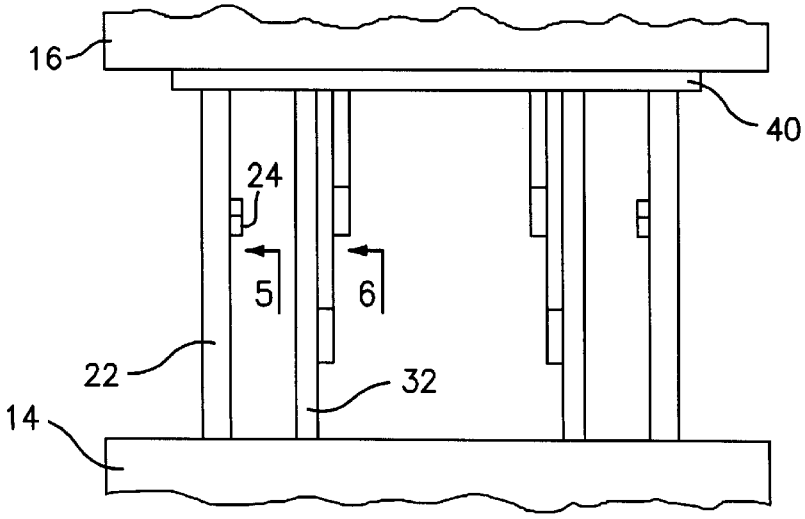
FIG. 4 is a top view of the table with the extension panel removed and showing the internal structure.

FIG. 4 shows a bird's eye view of part of the table structure. As shown in FIG. 4, the main top panel 14 has been pulled outwardly so as to open up an extension gap above the main table frame. In order to simplify the drawing, the extension panel 18 has been removed from the extension gap. The fixed frame 10 of the table has a pair of side frame members 22. A central stop rail 40 is disposed transverse the frame 10. The stop rail 40 is secured on top of the frame rails 22.

Figure 9:
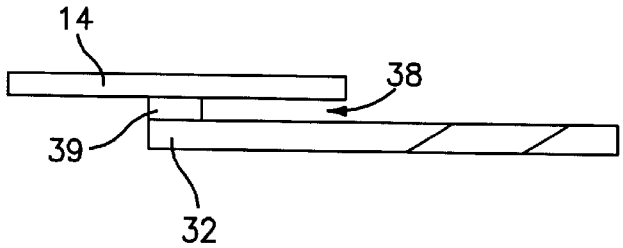
FIG. 9 is another side view of the sliding frame rail of FIG. 6, additionally showing the main top panel.

The main panel 14 is secured to a sliding frame that comprises a pair of rails 32. As seen in FIG. 9, the rails 32 are secured to the main panel 14 in such a way as to provide a clearance gap 38 for receiving the extension panel 18 when it is not in use; The inner ends of the sliding frame rails 32 pass through apertures in a centre portion (not shown) of the main frame 10. The main panel 14 is thus slidable by means of movement of the rails 32 into and out of the frame apertures.

Figure 5:
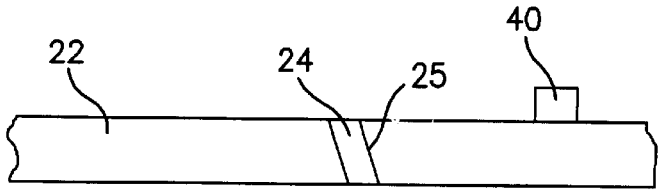
FIG. 5 is a side view of a table frame member, seen in the direction of arrow 5 of FIG. 4.
Figure 7:
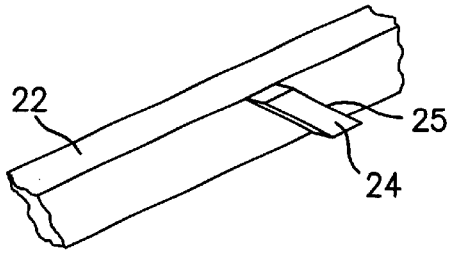
FIG. 7 is a perspective view of the table frame member of FIG. 5.

FIGS. 5 and 7 show detail of the structure of the frame member 22. A stop block 24 is mounted on the inside of each frame member 22. The block 24 is disposed at an angle inclined to the vertical in such a way that the bottom end of the block is closer to the centre of the table than the top end of the block. The stop block 24 thus provides an inclined surface 25.

Figure 6:
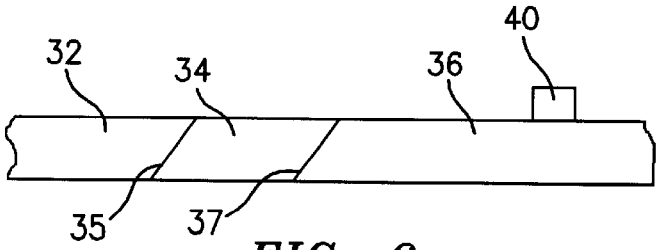
FIG. 6 is a side view of a sliding frame rail, seen in the direction of arrow 6 of FIG. 4.
Figure 8:
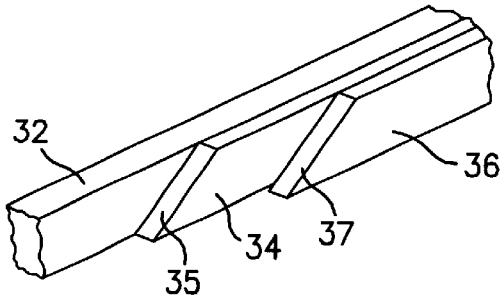
FIG. 8 is a perspective view of the sliding frame rail of FIG. 6.

FIGS. 6, 8 and 9 show detail of the structure of the sliding frame rail 32. As best seen in FIG. 8, the rail 32 comprises a laminar structure in which two timbers 34, 36 are secured to the side of a main timber. The ends of the timbers 34, 36 terminate in respective inclined surfaces 35, 37. In this embodiment, these inclined surfaces make an angle with the horizontal direction which is less than that of the inclined surface 25 of the stop block 24 on the frame member 22. The inclined surfaces 35 and 37 are staggered in the sliding direction, that is the longitudinal direction of the rail 32. They are also staggered in the transverse direction, that is the direction perpendicular to the sliding direction.

Figure 10:
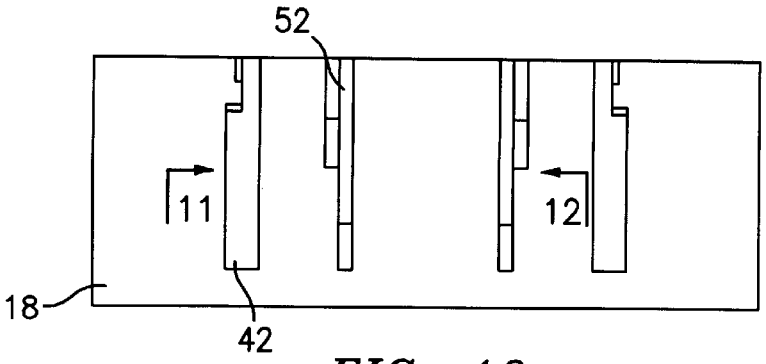
FIG. 10 is a view of the underside of an extension panel.

FIG. 10 shows the underside of the extension top panel 18. This is provided with guide means for interaction with the frame members 22 and sliding rails 32 of the table structure. There are a pair of outer rail-s 42 and a pair of inner rails 52.

Figure 11:
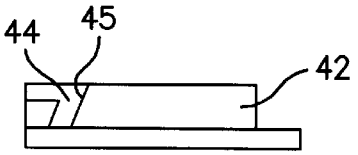
FIG. 11 is a side view of an outer guide rail, seen in the direction of arrow 11 of FIG. 10.
Figure 13:
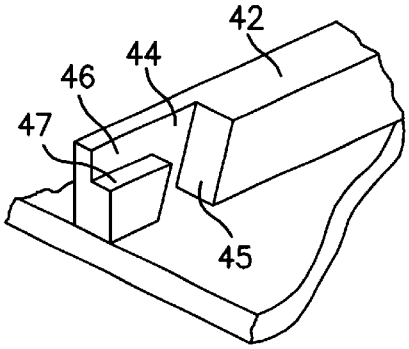
FIG. 13 is a perspective view of the outer guide rail of FIG. 11.

FIGS. 11 and 13 show detail of the outer rail 42. The outer rails are provided at positions corresponding to those of the main frame members 22. When the extension panel is placed over the extension gap, the outer surfaces of the rails 42 he adjacent the inner surfaces of the frame members 22. As best seen in FIG. 13, the outwardly facing side of the rail 42 has a slot 44 that provides an inclined surface 45. The inclined surface 45 of the slot makes the same-angle to the vertical as the inclined surface 25 of the stop block on the frame member. On the outer edge of the rail 42 (which faces the centre of the table), a recess or gap 46 is formed that extends to the end of the rail 42. This gap 46 defines a ledge 47 at a smaller height than the rest of the rail 42.

Figure 12:
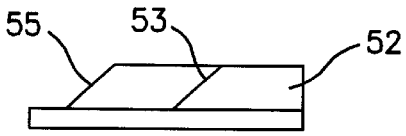
FIG. 12 is a side view of an inner guide rail, seen in the direction of arrow 12 of FIG. 10.
Figure 14:
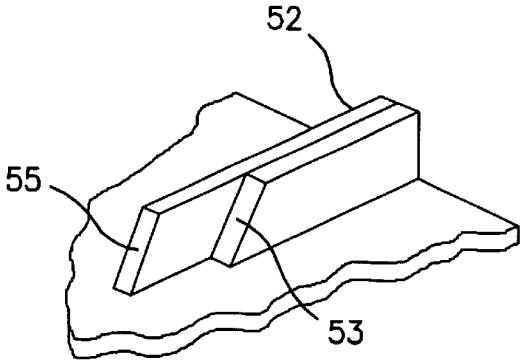
FIG. 14 is a perspective view of the inner guide rail of FIG. 12.

FIGS. 12 and 14 show detail of the inner rail 52. The inner rails 52 are located at positions corresponding to the sliding frame rails 32. The rail 52 comprises a pair of timbers disposed side by side, these timbers terminating in respective inclined surfaces 53 and 55. These inclined surfaces 53 and 55 are staggered in the sliding direction, that is the longitudinal direction of the rail 52. They are also staggered in the transverse direction, that is the direction perpendicular to the sliding direction. The angle of inclination of the inclined surfaces 53, 55 corresponds to that of the inclined surfaces 35, 37 of the sliding rail 32.

The structure of the table on the side of the other main top panel 16 and the structure of the other extension panel 20 are the same as those just described. The operation of the mechanism for raising and lowering the extension panel 18 into and out of the operative position will now be described. It will be understood that the description applies equally to the operation of the other extension panel 20.

When the table is set in its normal, unextended state (as shown in FIG. 1), the extension panel 18 is stowed beneath the associated main panel 14, being accommodated in the clearance gap 38 shown in FIG. 9. At this time, the flat undersurface of the extension panel 18 is seated on top of the sliding rails 32. The slopes 35, 37 are separated laterally from the slopes 53, 55, the sliding rails 32 being at substantially the same level as the inner guide rails 52. At this time, the stop blocks 24 on the main frame are received inside the slots 44 on the outer guide rails 42 of the extension panel. In this lower, stowed position the extension panel cannot make any sliding movement.

Figure 15:
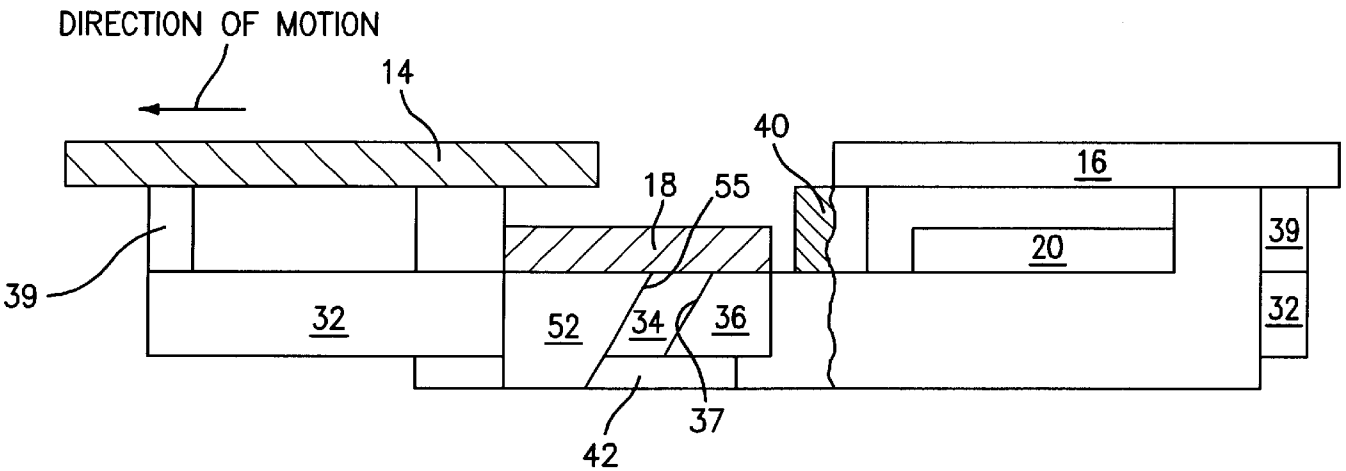
FIG. 15 is a partial cross-sectional view of the extendable table of FIG. 1B showing the position of the extension panel, its first and second guide means, the sliding rail and frame rails when the extension panel is in the stowed position taken along line 15—15.
Figure 16:
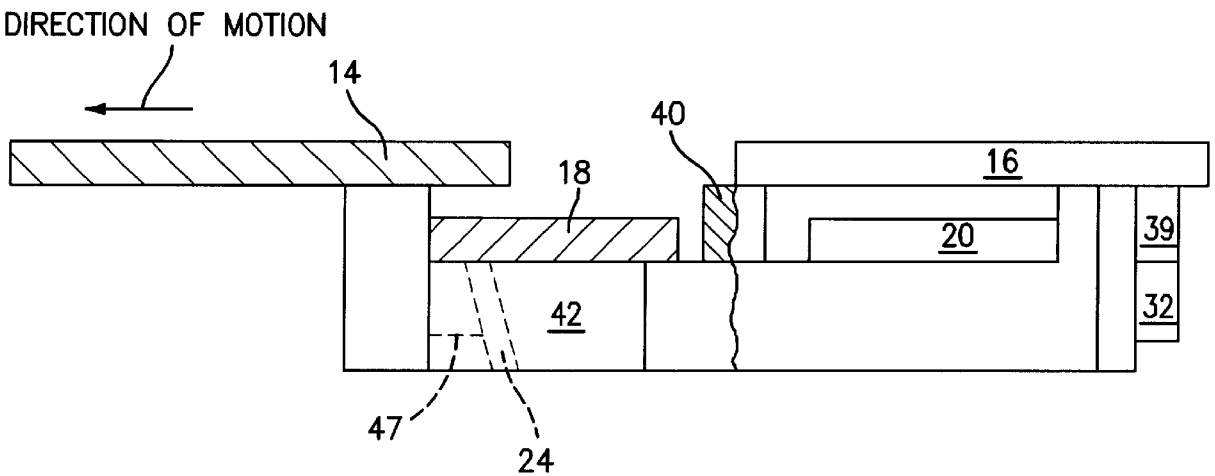
FIG. 16 is a partial cross-sectional view of the extendable table of FIG. 1B showing the position of the extension panel, second guide means and the stop block when the extension panel is in the stowed position taken along line 16—16.
Figure 17:
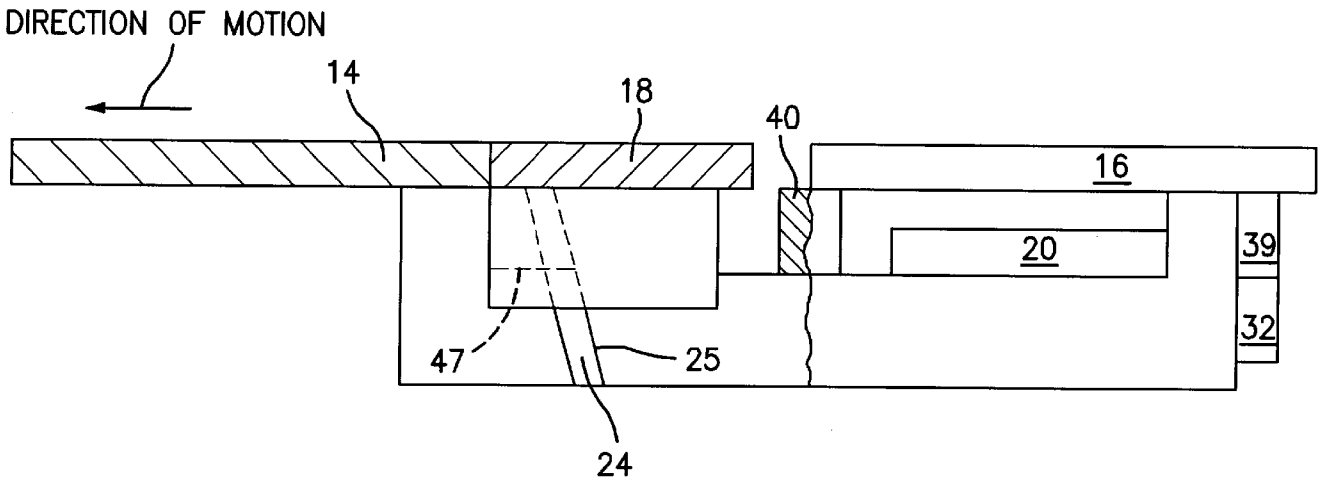
FIG. 17 is a partial cross-sectional view of the extendable table showing the position of the stop block and the second guide means when the extension panel is raised when the main panel is moved outwardly.
Figure 18:
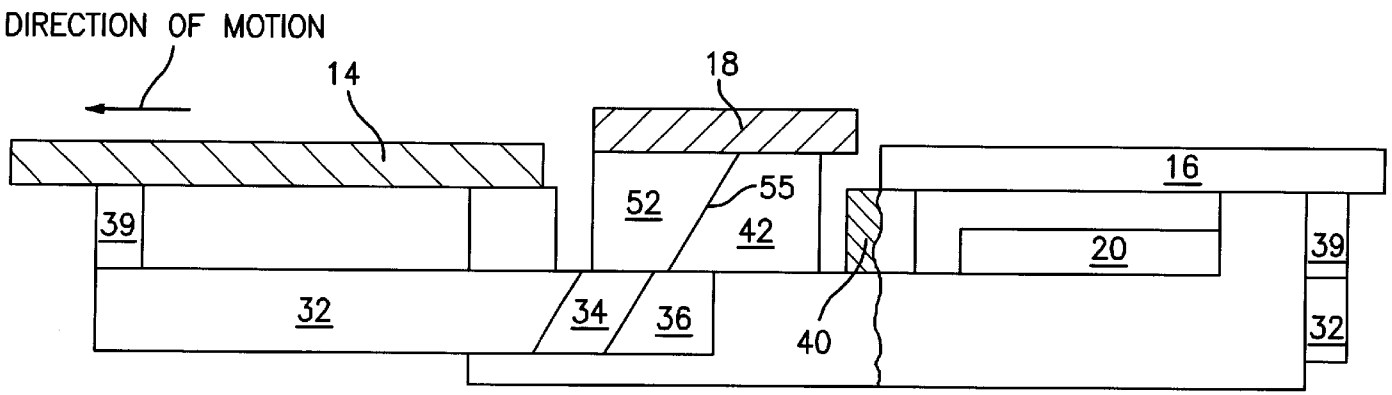
FIG. 18 is a partial cross-sectional view of the extendable table showing the position of the extension panel and its first and second guide means at the end of the vertical travel of the extension panel.
Figure 19:
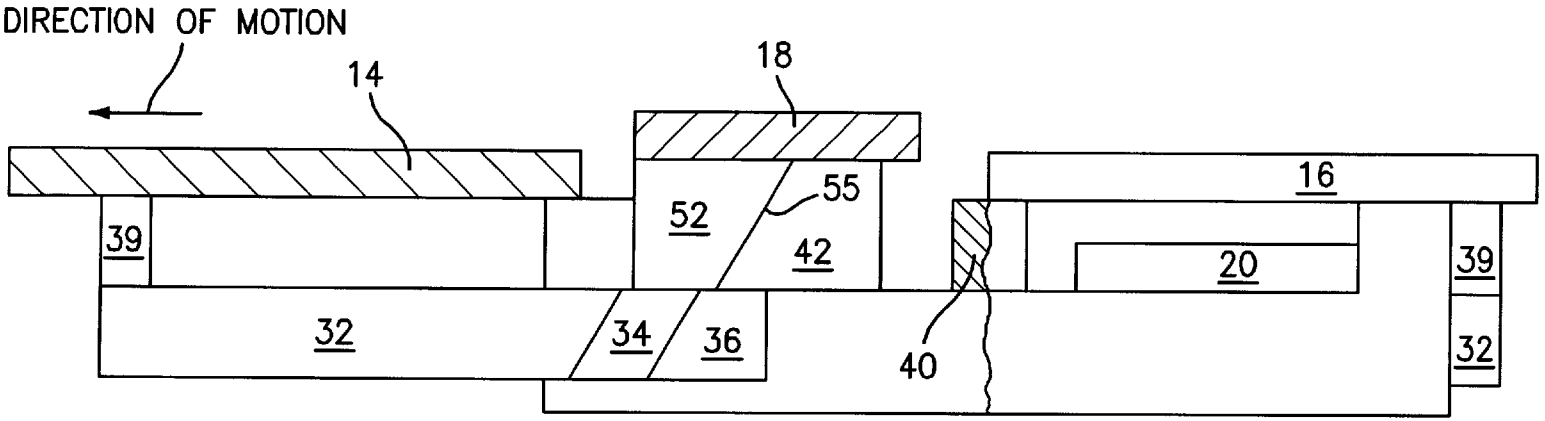
FIG. 19 is a partial cross-sectional view of the extendable table showing the position of the extension panel when the main panel is further moved outwardly.

In order to extend the table, the main panel is pulled outwardly (FIGS. 15 and 16). In doing so, the sliding rails 32 slip underneath the extension panel until the slopes 35, 37 thereof come into contact with the slopes 53, 55 of the extension panel. At this time, the extension panel begins to move upwardly under a scissors action. As the separation between the slopes 35, 37 on the sliding rails and the slopes 25 on the fixed frame is reduced, the extension panel is forced upward. The slopes 53, 55 thus ride up the slopes 35, 37 and, at the same time, the slots 44 on the outer guide rails of the extension panel move out of their substantially vertical alignment with the stop blocks 24 (FIG. 17). At the end of the vertical travel, the extension panel sits on top of the sliding rails, so that the top edges of the sliding rails contact the underside edges of the inner guide rails 32 of the extension panel. At this time, the slots on the outer guide rails have lifted clear of the fixed blocks on the main frame (FIG. 18). Thus, the extension panel can now move with the sliding rails (FIG. 19).

Figure 20:
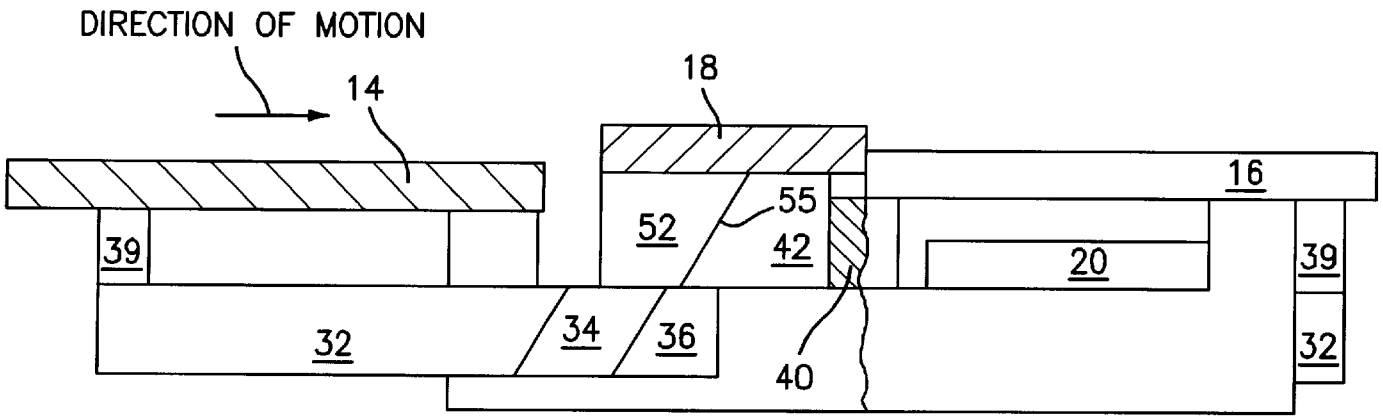
FIG. 20 is a partial cross-sectional view of the extendable table when the main panel is pushed inwardly.

The main panel is next pushed inwardly and the extension panel similarly moves inwardly until it is stopped by the centre stop rail 40 (FIG. 20). Since the extension panel has been stopped by the rail 40, further inward movement of the main panel causes the separation of the sliding rail 32 from the inner guide rail 52 of the extension panel. When the slopes 53, 55 of the extension panel come into contact with the corresponding slopes 35, 37 of the guide rail 32, the extension panel starts to lower as it comes to be seated on the slopes 35, 37 rather than on the top surface of the sliding rail. The lowering of the extension panel is arrested when the lower side of the extension panel engages the top of the stop rail 40. At this point, the gap 46 of the outer guide rail 42 of the extension panel comes into alignment with the stop block, so that the top of the stop block 24 contacts the ledge or shoulder 47 of the guide rail 42 and thereby supports the extension panel.

Figure 21:
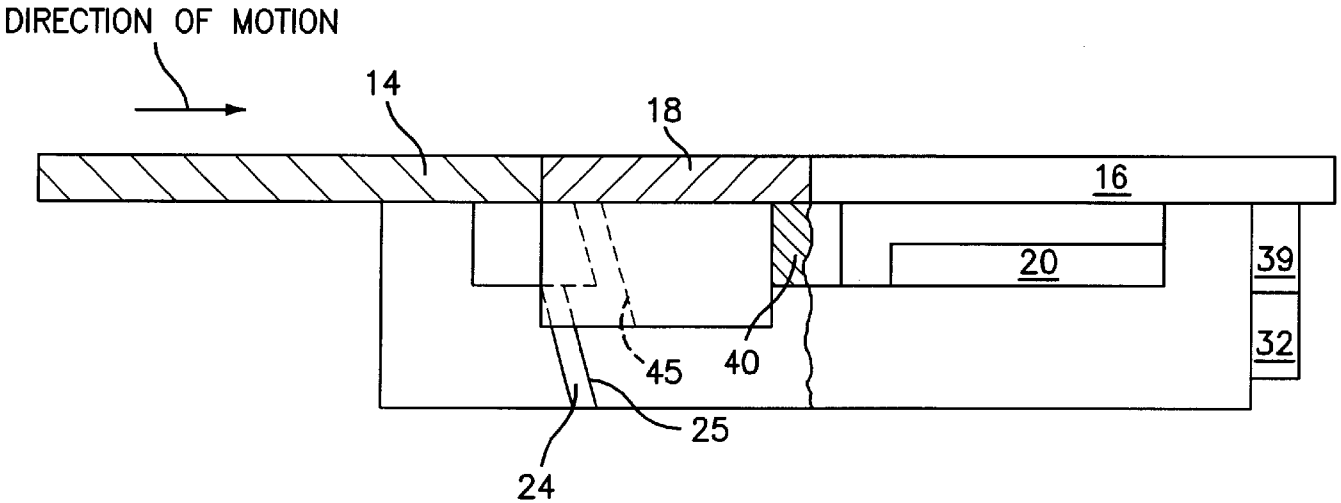
FIG. 21 is a partial cross-sectional view of the extendable table showing the position of the extension panel, the second guide means and the stop block when the table is fully extended on one end.
Figure 22:
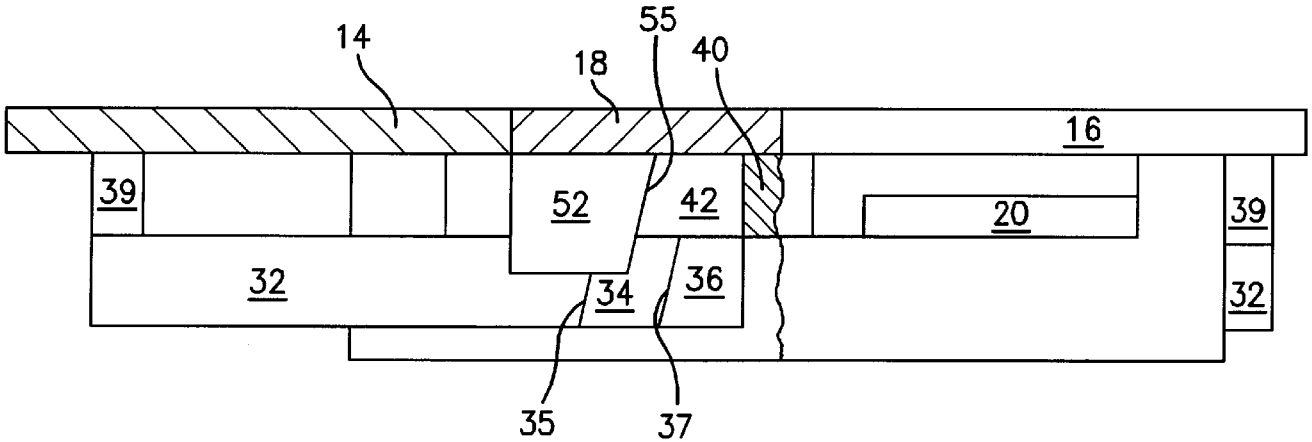
FIG. 22 is a partial cross-sectional view of the table showing the position of the first and second guide means of the extension panel, the sliding rail and sliding frames when the table is fully extended on one end.

Finally, the main panel is pushed further inwardly so as to bring the inner edge of the main panel 14 into intimate edgewise contact with the outer facing edge of the extension panel 18. The table has now assumed the extended condition shown in FIGS. 2, 21 and 22.

In order to close the table back to its normal size, the main panel is pulled outwardly once again. The slopes 35, 37 and 53, 55 come into mutual contact and the extension panel moves outwardly until the slope 25 meets the slope 45 when the stop block 24 becomes aligned with the slot 44 (e.g., in the same position as FIG. 17). At this point, the user feels a knock as the edge of the stop block 24 comes into contact with the edge of the slot 44, and the outward pulling action on the main panel is stopped. The main panel is now pushed inwardly.

As the separation between the slopes 35, 37 of the sliding rails 32 from the slopes 53, 55 of the inner guide rails of the extension panel increases, the extension panel is automatically lowered into its original position with the gap of increasing size. When the extension panel has reached its lowest position, the main panel is slid inwardly over the top of the extension panel and the extension panel enters the clearance gap 38 shown in FIG. 9 provided by spacer block 39 between panel 14 and rail 32. Finally, the inner edge of the main panel reaches the stop rail 40. The table thus assumes the condition shown in FIG. 1.

In the above described embodiment, each sliding rail has a pair of inclined guide surfaces 35, 37 and each inner rail of the extension panel has a corresponding pair of inclined guide surfaces 53, 55. The use of such pairs of inclined surfaces, staggered in the sliding direction, is preferred since this ensures that the extension panel remains level as it is moved between the operative and stowed positions.

The invention may be embodied in numerous other specific forms without departing from the scope thereof as defined by the following claims.

What is claimed is:

1. An extendable table comprising:

a fixed frame (10, 22) comprising a pair of frame members (22), each having an inclined surface (25);

a sliding frame (32) arranged to be slidably movable relative to said fixed frame and comprising a pair of rails (32), each including a pair of inclined surfaces (35, 37) spaced apart in the sliding direction;

a main top panel (14) secured to said sliding frame whereby said main top panel may be pulled outwardly to open up an extension gap over said fixed frame; and an extension top panel (18) locatable on said sliding frame (32) and within said extension gap to form a continuous extended table surface with said main top panel (14) and comprising:

first guide means (52) interacting with said sliding frame (32) comprising a corresponding pair of first inclined surface (53, 55) for each frame rail spaced apart in the sliding direction which engages the frame rail inclined surface (35, 37) as the extension top panel moves between said lower and upper positions; and second guide means (42) interacting with said inclined surfaces (25) of the frame members (22) of the fixed frame whereby, when the main top panel (14) is pulled outwardly, the extension top panel (18) is caused to be lifted automatically within said extension gap from a lower position below the level of the main top panel to an upper position at the level of the main top panel, and wherein the extension top panel (18) is stowed beneath the main top panel (14) when said extension gap is closed.

2. An extendable table according to claim 1, wherein said second guide means (42) of the extension top panel (18) includes a second inclined surface (45) which engages the frame member inclined surface (25) as the extension top panel moves between said lower and upper positions.

3. An extendable table according to claim 2 wherein the extension top panel (18) is lifted automatically from said lower position by a scissors action in which the frame rail inclined surface (35, 37) and the frame member inclined surface (25) are moved closer to each other thereby forcing the extension top panel to move in an upward direction.

4. An extendable table according to claim 3, wherein said second guide means of the extension top panel (18) comprises a slot (44) arranged to receive a guide block (24) provided on said frame member.

5. An extendable table according to claim 4, wherein the first guide means (53, 55) are formed on a pair of first guide rails (52) of the extension top panel and the second guide means (44, 45) are formed on a pair of second guide rails (42) of the extension top panel.

6. An extendable table according to claims 5, further comprising a stop rail (40) secured to the fixed frame (10), said stop rail serving to prevent inward travel of the extension top panel (18) as the main top panel (14) is moved inwardly to bring the two panels into intimate edgewise contact.

7. An extendable table according to claim 6, further comprising a second sliding frame (32), a second main top panel (16), a second extension top panel (20), and a mechanism linking the same as aforeclaimed, whereby the table top surface is extendable optionally by the inclusion of one or both of the first and second extension top panels (18, 20).

* * * * *